US007207244B2

(12) United States Patent
Chen

(10) Patent No.: US 7,207,244 B2
(45) Date of Patent: Apr. 24, 2007

(54) SELECTIVE ONE-WAY WRENCH

(76) Inventor: Terence Chen, No. 325, Yung Ching Road, Tung Shan Hsiang, Lo Tung Town, Yi Lan Hsien (TW)

( * ) Notice: Subject to any disclaimer, the term of this patent is extended or adjusted under 35 U.S.C. 154(b) by 15 days.

(21) Appl. No.: 11/190,523

(22) Filed: Jul. 28, 2005

(65) Prior Publication Data

US 2005/0257651 A1 Nov. 24, 2005

Related U.S. Application Data

(63) Continuation-in-part of application No. 10/724,231, filed on Dec. 1, 2003, now Pat. No. 6,964,216.

(51) Int. Cl.
*B25B 13/46* (2006.01)

(52) U.S. Cl. ..... 81/63.2; 81/63

(58) Field of Classification Search ..... 81/60–63.2
See application file for complete search history.

(56) References Cited

U.S. PATENT DOCUMENTS 2,943,523 A * 7/1960 Gray et al. ..... 81/63
4,274,311 A * 6/1981 Ebert ..... 81/63
4,420,995 A 12/1983 Roberts ..... 81/60
6,134,991 A * 10/2000 Chaconas ..... 81/63
6,145,412 A * 11/2000 Cheng et al. ..... 81/57.29
6,457,388 B1 * 10/2002 Chen ..... 81/63.2
6,513,409 B1 * 2/2003 Lee ..... 81/63
2003/0051583 A1 3/2003 Lin ..... 81/60
2005/0145074 A1 * 7/2005 Mau ..... 81/63
2006/0081092 A1 * 4/2006 Chen ..... 81/63

* cited by examiner

*Primary Examiner*—Debra Meislin
(74) *Attorney, Agent, or Firm*—Rosenberg, Klein & Lee

(57) ABSTRACT

A selective one-way wrench includes a head defining a first space and a second space communicated with the first space. A gear is put pivotally in the first space. The gear includes a toothed external face. A direction controller is put in the second space. The direction controller includes two toothed faces. A spring pushes the direction controller to the gear. A direction switch includes a first element put pivotally on the head and a second element put in the second space and connected to the first element for bringing selected one of the toothed faces of the direction controller into engagement with the toothed external face of the gear.

25 Claims, 10 Drawing Sheets

SELECTIVE ONE-WAY WRENCH

CROSS-REFERENCE

The present application is a continuation-in-part application of U.S. patent application Ser. No. 10/724231 filed Dec. 1, 2003, now U.S. Pat. No. 6,964,216 that is incorporated herein for detailed description of the subject matter claimed in the present application.

BACKGROUND OF INVENTION

1. Field of Invention

The present invention relates to a selective one-way wrench.

2. Related Prior Art

In U.S. Pat. No. 4,420,995, there is disclosed a conventional selective one-way wrench including a head 1, a gear 10 and a direction controller (not shown) provided between the head 1 and the gear 10. The gear 10 includes an insert 9 for insertion in a socket 16 for engagement with a bolt or nut. A detent 12 is put in the insert 9. A pin 2 is put in the insert 9 for controlling the detent 12.

In Application US2003/0051583, there is disclosed a conventional one-way wrench including a head 11, a gear 40 and a one-way transmission provided between the head 11 and the gear 40. The one-way transmission includes a block 20, a pawl 50 and a spring 60 for connecting the pawl 50 to the block 20. This conventional one-way wrench can be used to drive a bolt or nut in a direction, but cannot be used to drive the bolt or nut in an opposite direction unless it is turned upside down. However, if the gear 40 is of the type that includes an insert for insertion in a socket for engagement with a bolt or nut, such turning will be impossible in use. Therefore, there is no adequate reason for modifying this conventional one-way wrench by including the gear 10 formed with the insert 9, the detent 12 and the gear 10 disclosed in U.S. Pat. No. 4,420,995.

The present invention is therefore intended to obviate or at least alleviate the problems encountered in prior art.

SUMMARY OF INVENTION

The primary objective of the present invention is to provide a selective one-way wrench.

A selective one-way wrench includes a head defining a first space and a second space communicated with the first space. A gear is put in the first space. The gear includes a toothed external face. A direction controller is put in the second space. The direction controller includes two toothed faces. A spring pushes the direction controller to the gear. A direction switch includes a first element put pivotally on the head and a second element put in the second space and connected to the first element for bringing selected one of the toothed faces of the direction controller into engagement with the toothed external face of the gear.

Other objects, advantages, and novel features of the invention will become more apparent from the following detailed description when taken in conjunction with the attached drawings.

BRIEF DESCRIPTION OF DRAWINGS

The present invention will be described through detailed description of embodiments referring to the drawings.

DETAILED DESCRIPTION OF EMBODIMENTS

Figure 1:
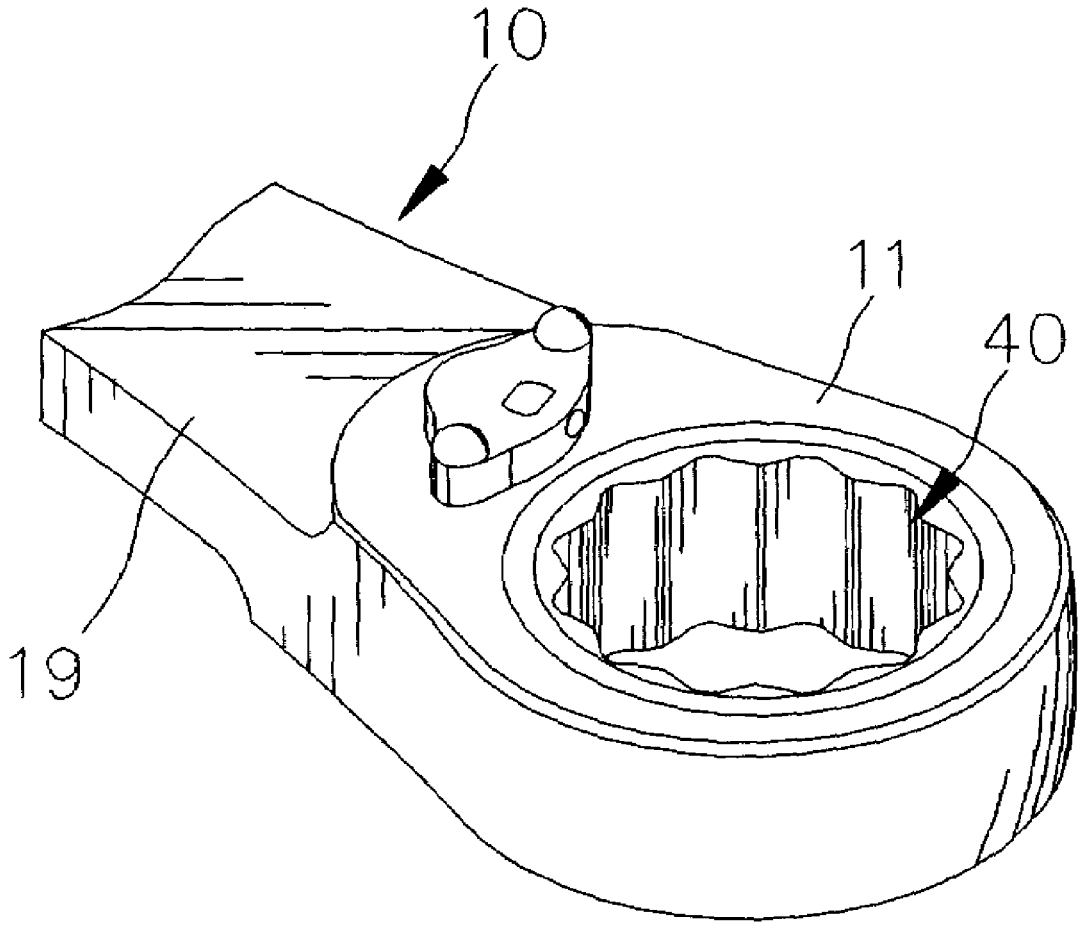
FIG. 1 is a perspective view of a selective one-way wrench according to a first embodiment of the present invention.

Referring to FIG. 1, according to a first embodiment of the present invention, a selective one-way wrench 10 includes a head 11 and a handle 19 extending from the head 11.

Figure 2:
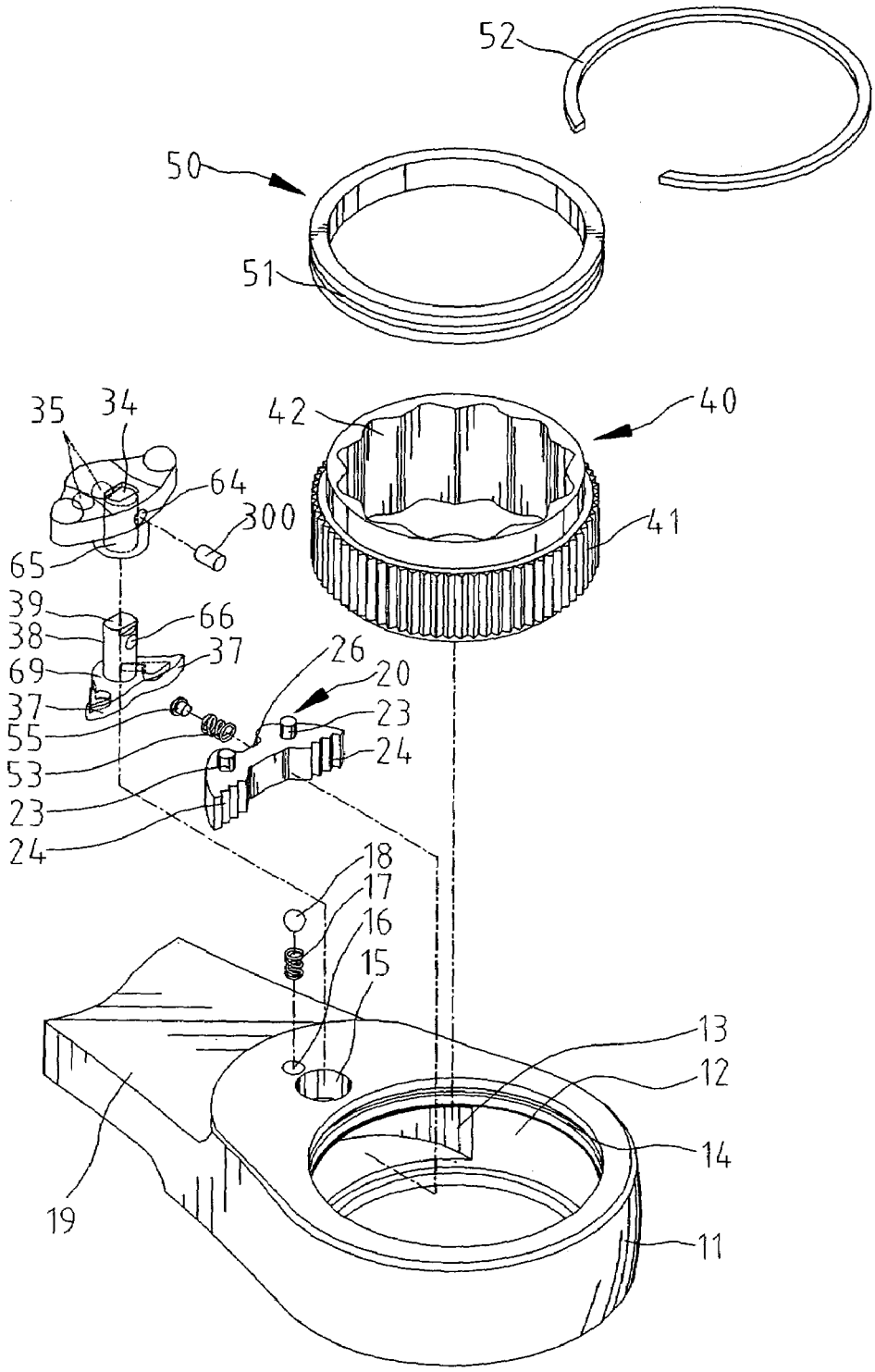
FIG. 2 is an exploded view of the selective one-way wrench shown in FIG. 1.

Referring to FIG. 2, the head 11 defines a circular space 12, a crescent space 13 communicated with the circular space 12, an annual groove 14 defined in the wall of the circular space 12, an aperture 15 communicated with the crescent space 13, and a recess 16.

A direction controller 20 is put in the crescent space 13. The direction controller 20 includes a top, a bottom, a first side formed with two toothed faces 24, and a second side in which a recess 26 is defined.

A spring 53 and a mushroom-shaped element 55 are put between the second side of the direction controller 20 and the wall of the crescent space 13. The spring 53 is used to push the direction controller 20 to the annular gear 40. The spring 53 includes an end put in the recess 26 and an opposite end receiving a small portion of the mushroom-shaped element 55. A large portion of the mushroom-shaped element 55 ensures smooth sliding on the wall of the crescent space 13.

An O-ring 50 is put in the circular space 12. The O-ring 50 includes an annular groove 51 defined in an external face thereof.

A C-ring 52 includes an internal edge put in the annular groove 51 and an external edge put in the annular groove 14. Thus, the O-ring 50 is attached to the head 11 by means of the C-ring 52.

An annular gear 40 is put in the circular space 12. The annular gear 40 is put on the O-ring 50. The annular gear 40 includes a toothed internal face 42 for engagement with a bolt or nut and a toothed external face 41 for engagement with selected one of the toothed faces 24.

A spring 17 and a detent 18 are put in the recess 16.

A direction switch 30 includes a first element 31 and a second element 36. The first element 31 includes a handle 32 and a cylinder 33 extending from the handle 32. The handle 32 includes a slot 34 defined in a top, two recesses 35 defined in the bottom, and an aperture 64 defined in a side. The cylinder 33 defines a hole 65 communicated with the slot 34 and the aperture 64.

The second element 36 includes a rod 38 and two substantially opposite hooks 37 extending from the rod 38. Preferably, the hooks 37 are formed on the bottom of a reinforcement plate 69 formed at a lower end of the rod 38. A ridge 39 extends from the rod 38. A recess 66 is defined in the rod 38 near the ridge 39.

The second element 36 is put in the crescent space 13 before the direction controller 20. The rod 38 extends through the aperture 15. The first element 31 is put on the handle 19. The rod 38 is inserted into the cylinder 33. The first element 31 is firmly attached to the second element 36 by means of a pin 300 fit into the recess 66 through the aperture 64. Hence, the direction switch 30 is installed on the handle 19 and the head 11 rotationally. The detent 18 enters selected one of the recess 35.

Figure 3:
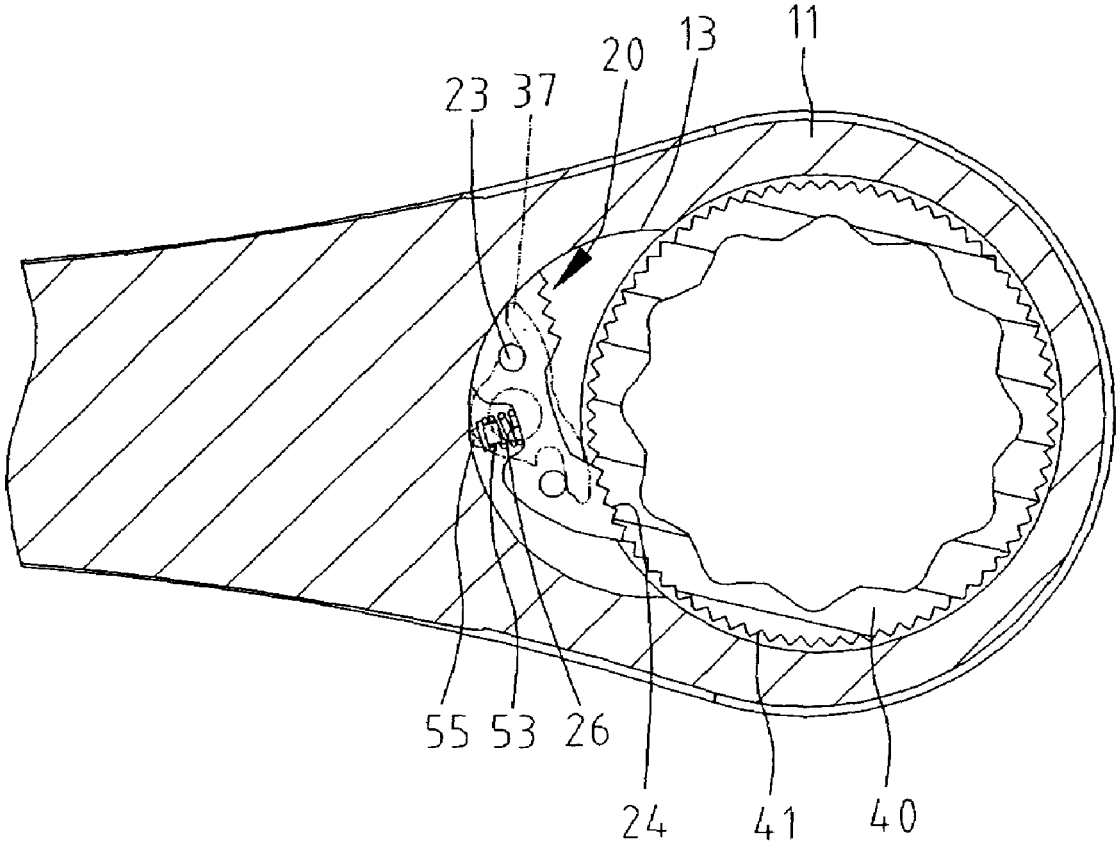
FIG. 3 is a cross-sectional view of the selective one-way wrench of FIG. 1 for counterclockwise driving.

Referring to FIG. 3, the direction controller 20 is moved into an end of the crescent space 13. One of the toothed faces 24 is engaged with the toothed external face 41. Thus, the head 11 can drive the annular gear 40 counterclockwise, but not vice versa.

Figure 4:
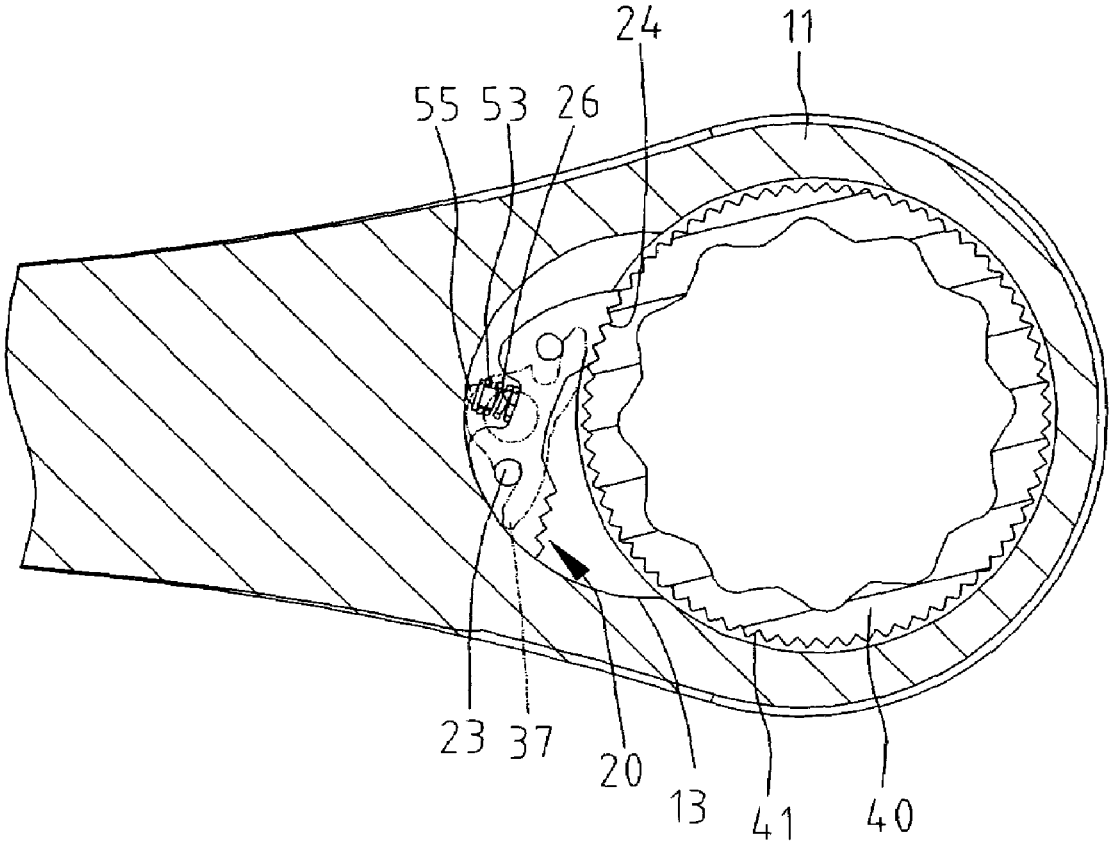
FIG. 4 is similar to FIG. 3 but shows the selective one-way wrench for clockwise driving.

Referring to FIG. 4, the direction controller 20 is moved into the other end of the crescent space 13. The other of the toothed faces 24 is engaged with the toothed external face 41. Thus, the head 11 can drive the annular gear 40 clockwise, but not vice versa.

Figure 5:
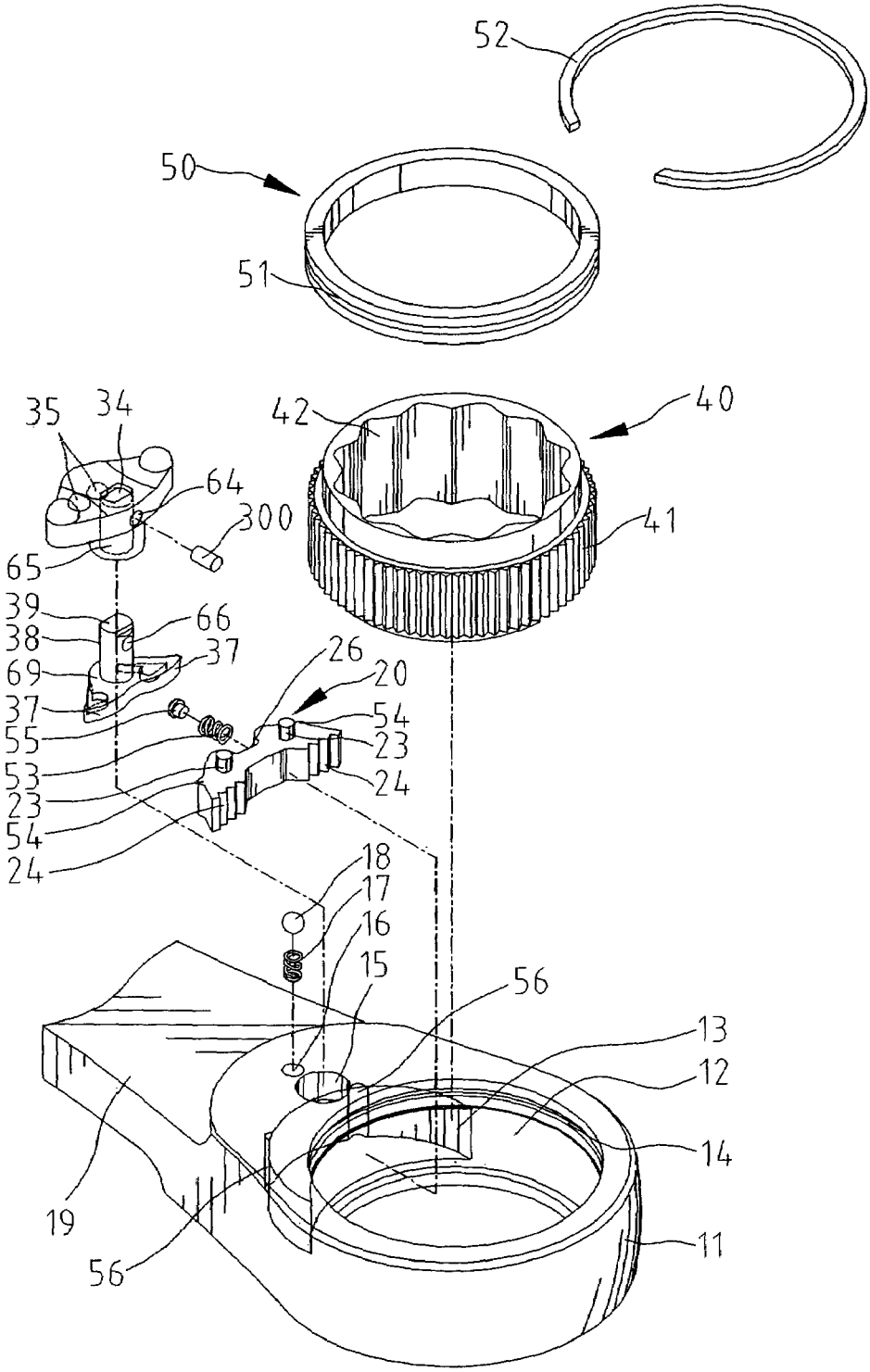
FIG. 5 is an exploded view of a selective one-way wrench according to a second embodiment of the present invention.
Figure 6:
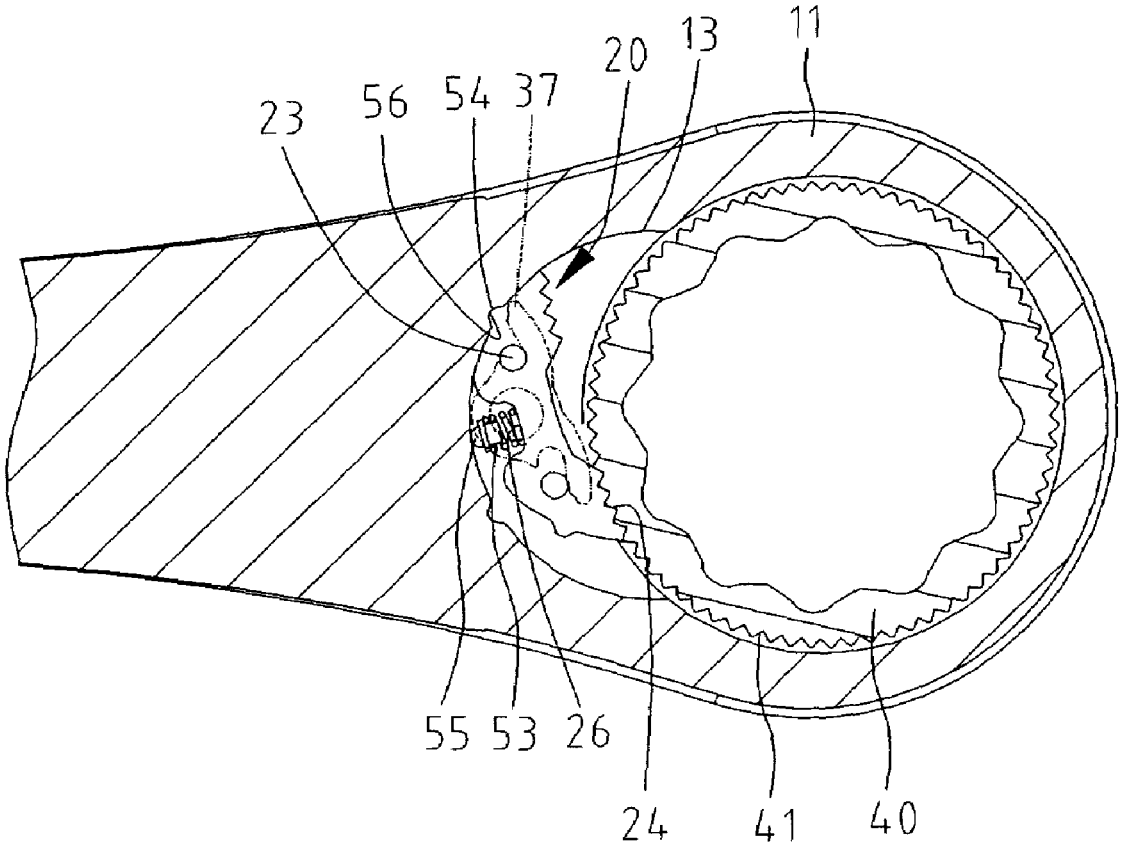
FIG. 6 is a cross-sectional view of the selective one-way wrench of FIG. 5 for counterclockwise driving.
Figure 7:
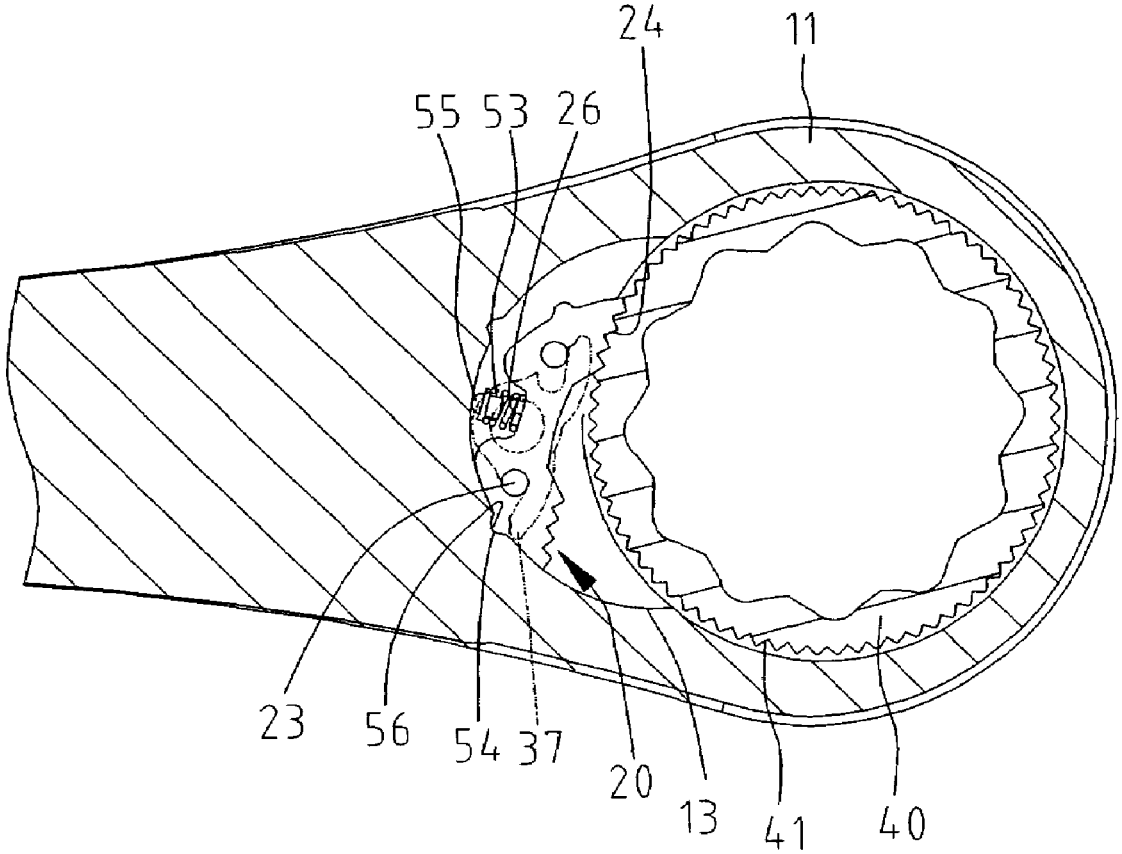
FIG. 7 is similar to FIG. 6 but shows the selective one-way wrench for clockwise driving.

FIGS. 5 through 7 shows a selective one-way wrench according to a second embodiment of the present invention. The second embodiment is similar to the first embodiment except that the direction controller 20 includes two bosses 54 formed on the second side and that the head 11 defines two recesses 56 in the wall of the crescent space 13.

Referring to FIG. 6, the direction controller 20 is in an end of the crescent space 13. One of the toothed faces 24 is engaged with the toothed external face 41. The head 11 can drive the annular gear 40 counterclockwise. One of the bosses 54 is put in one of the recesses 56 in order to keep the direction controller 20 in position.

Referring to FIG. 7, the direction controller 20 is in the other end of the crescent space 13. The other of the toothed faces 24 is engaged with the toothed external face 41. The head 11 can drive the annular gear 40 clockwise, but not vice versa. The other of the bosses 54, is put in the other of the recesses 56 in order to keep the direction controller 20 in position.

Figure 8:
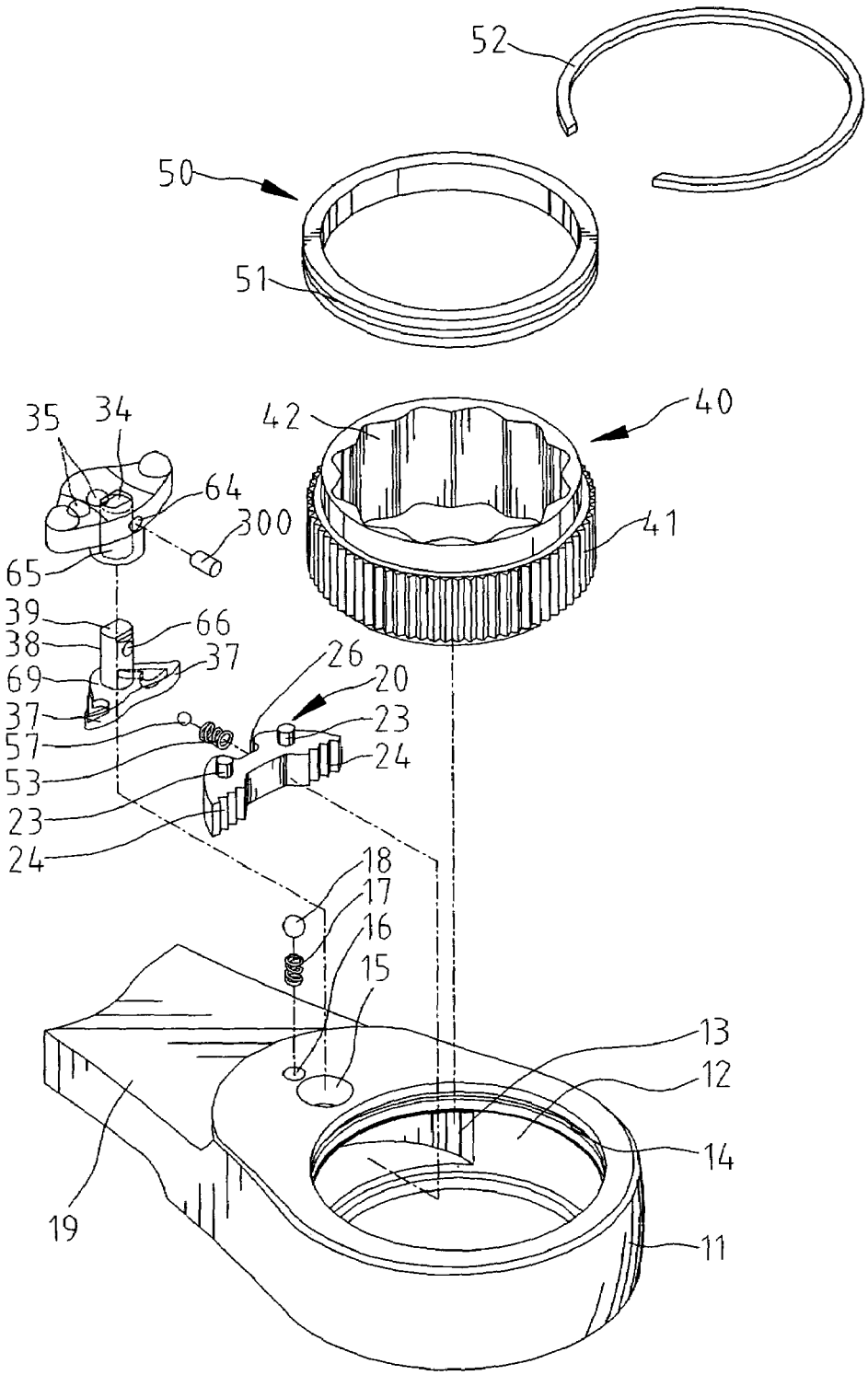
FIG. 8 is an exploded view of a selective one-way wrench according to a third embodiment of the present invention.
Figure 9:
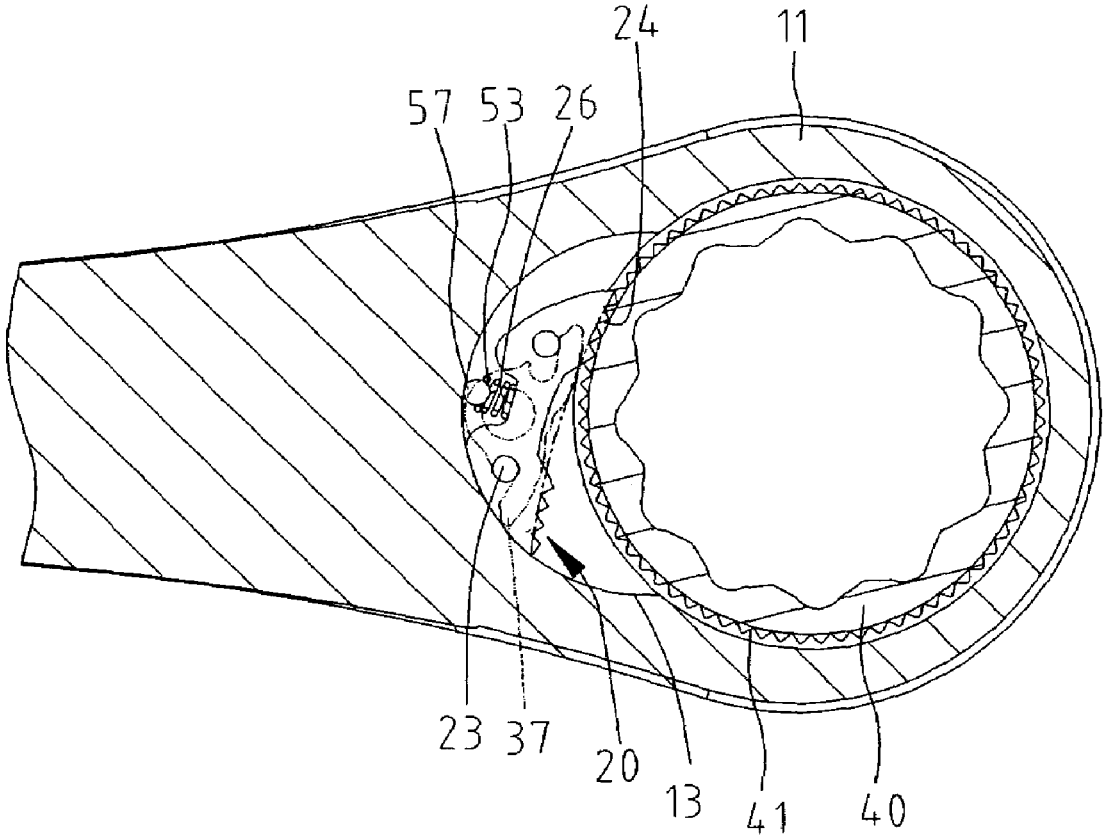
FIG. 9 is a cross-sectional view of the selective one-way wrench of FIG. 5 for clockwise driving.

FIGS. 8 and 9 show a selective one-way wrench according a third embodiment of the present invention. The third embodiment is similar to the first embodiment except including a ball 57 instead of the mushroom-shaped element 55.

Figure 10:
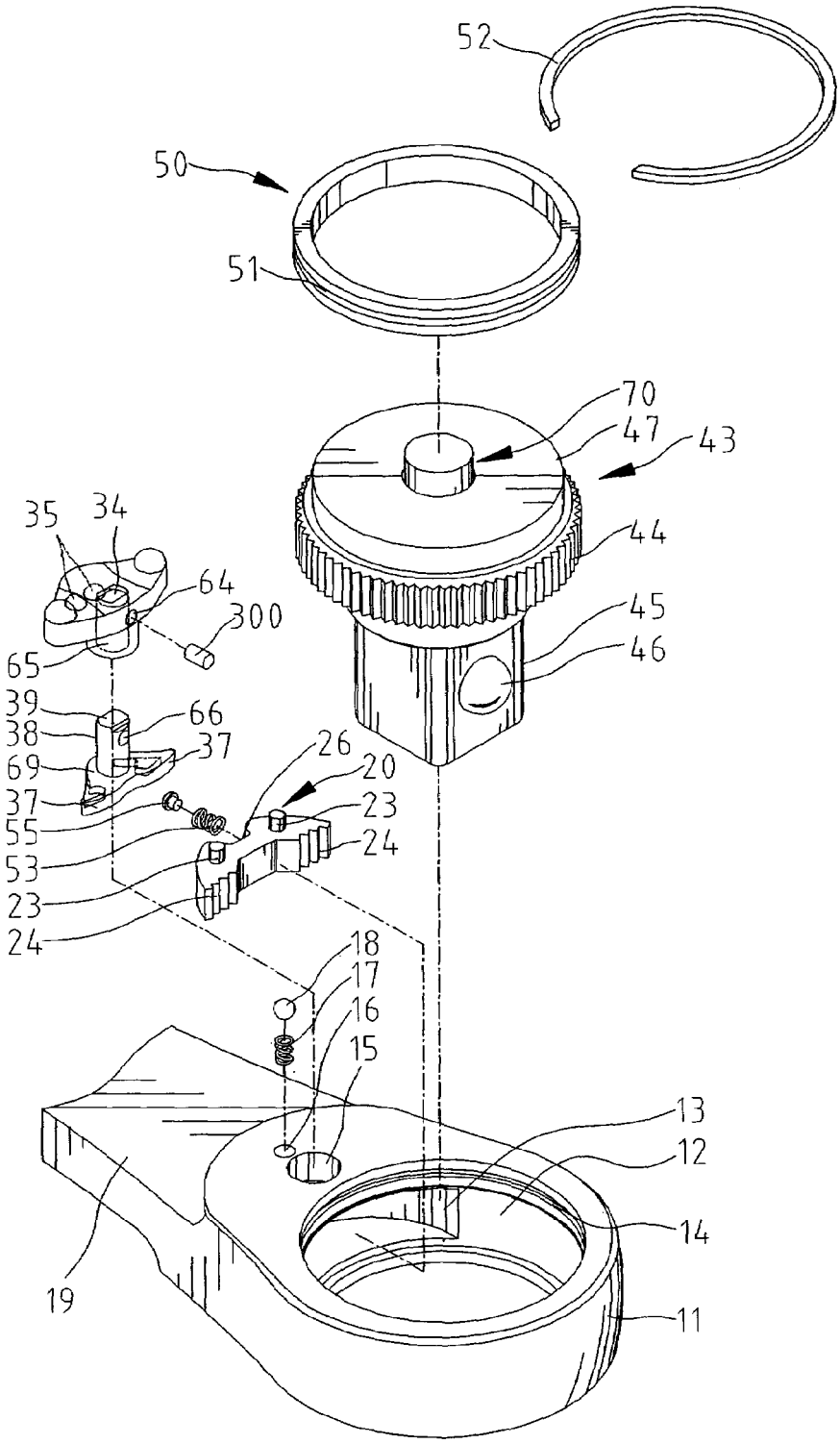
FIG. 10 is an exploded view of a selective one-way wrench according to a fourth embodiment of the present invention.

FIG. 10 shows a selective one-way wrench according to a fourth embodiment of the present invention. The second embodiment is identical to the first embodiment except including a joint 43 instead of the annular gear 40. The joint 43 includes a disc 47 with a toothed face 44 formed on its periphery and a control device 70. On the bottom of the disc 47 is formed a square insert 45 for insertion in a square hole defined in a socket (not shown). A detent 46 is installed on the square insert 45. The detent 46 is controlled by means of the control device 70.

The present invention has been described through detailed description of the embodiments. Those skilled in the art can derive variation from the embodiments without departing from the scope of the present invention. Hence, the embodiments shall not limit the scope of the present invention defined in the claims.

What is claimed is:

1. A selective one-way wrench comprising:

a head defining a first space and a second space communicated with the first space;

a gear put in the first space, the gear comprising a toothed external face;

a direction controller put in the second space, the direction controller comprising two toothed faces, the direction controller including two bosses formed thereon, the head having two recesses defined in the wall of the second space for receiving the bosses, one at a time;

a spring for pushing the direction controller to the gear; and a direction switch comprising a first element put pivotally on the head and a second element put in the second space and connected to the first element for bringing a selected one of the toothed faces of the direction controller into engagement with the toothed external face of the gear.

2. The selective one-way wrench according to claim 1 wherein the direction controller defines a recess for receiving an end of the spring.

3. The selective one-way wrench according to claim 1 comprising a mushroom-shaped element for ensuring smooth sliding of an end of the spring on the wall of the second space.

4. The selective one-way wrench according to claim 1 comprising a ball for ensuring smooth sliding of an end of the spring on the wall of the second space.

5. The selective one-way wrench according to claim 1 comprising a spring-biased detent provided on the head, wherein the first element of the direction switch comprises a handle defining two recesses selected one of which receives the spring-biased detent so that the handle is retained in selected one of two positions.

6. The selective one-way wrench according to claim 1 wherein the gear is an annular gear.

7. The selective one-way wrench according to claim 1 wherein the gear comprises an insert for insertion in a socket and a detent attached to the insert for retaining the socket on the insert.

8. The selective one-way wrench according to claim 7 wherein the detent is switched between an extended position for retaining the socket and a withdrawn position for releasing the socket.

9. The selective one-way wrench according to claim 8 comprising a control device for controlling the switching of the detent between the extended position and the withdrawn position.

10. A selective one-way wrench comprising:

a head defining a first space and a second space communicated with the first space;

a gear put in the first space, the gear having a toothed external face;

a direction controller put in the second space, the direction controller having two toothed faces;

a spring for pushing the direction controller to the gear; and a direction switch including a first element put pivotally on the head and a second element put in the second space and connected to the first element for bringing a selected one of the toothed faces of the direction controller into engagement with the toothed external face of the gear, the first element of the direction switch including a cylinder, wherein the second element has a rod inserted in the cylinder of the first element.

11. The selective one-way wrench according to claim 10 wherein the first element comprises a slot communicated with the hole of the cylinder, and the second element comprises a ridge extending from the rod, and the slot of the first element receives the ridge of the second element.

12. The selective one-way wrench according to claim 10 comprising a pin for securing the cylinder of the first element to the rod of the second element.

13. A selective one-way wrench comprising:

a head defining a first space and a second space communicated with the first space;

a gear put in the first space, the gear having a toothed external face;

a direction controller put in the second space, the direction controller having two toothed faces, the direction controller including two rods formed thereon, wherein the second element of the direction switch includes two hooks each for hooking one of the rods;

a spring for pushing the direction controller to the gear; and a direction switch including a first element put pivotally on the head and a second element put in the second space and connected to the first element for bringing a selected one of the toothed faces of the direction controller into engagement with the toothed external face of the gear.

14. The selective one-way wrench according to claim 13 wherein the second element of the direction switch comprises a reinforcement plate with a bottom on which the hooks are formed.

15. A selective one-way wrench comprising:

a head defining a first space, a second space communicated with the first space and two recesses defined in the wall of the second space;

a gear put in the first space, the gear comprising a toothed external face;

a direction controller put in the second space, the direction controller comprising two toothed faces and two bosses for insertion in the recesses one at a time;

a spring for pushing the direction controller to the gear; and a direction switch inserted into the second space for bringing selected one of the toothed faces of the direction controller into engagement with the toothed external face of the gear.

16. The selective one-way wrench according to claim 15 wherein the direction controller defines a recess for receiving an end of the spring.

17. The selective one-way wrench according to claim 15 comprising a mushroom-shaped element for ensuring smooth sliding of an end of the spring on the wall of the second space.

18. The selective one-way wrench according to claim 15 comprising a ball for ensuring smooth sliding of an end of the spring on the wall of the second space.

19. The selective one-way wrench according to claim 15 comprising a spring-biased detent provided on the head, wherein the direction switch comprises a handle defining two recesses selected one of which receives the spring-biased detent in order to retain the handle in selected one of two positions.

20. The selective one-way wrench according to claim 15 wherein the direction controller comprises two rods formed thereon, wherein the direction switch comprises two hooks each for hooking one of the rods.

21. The selective one-way wrench according to claim 20 wherein the direction switch comprises a reinforcement plate with a bottom on which the hooks are formed.

22. The selective one-way wrench according to claim 15 wherein the gear is an annular gear.

23. The selective one-way wrench according to claim 15 wherein the gear comprises an insert for insertion in a socket and a detent attached to the insert for retaining the socket on the insert.

24. The selective one-way wrench according to claim 23 wherein the detent is switched between an extended position for retaining the socket and a withdrawn position for releasing the socket.

25. The selective one-way wrench according to claim 24 comprising a control device for controlling the switching of the detent between the extended position and the withdrawn position.

* * * * *